US007785237B2

(12) United States Patent
Alessandri et al.

(10) Patent No.: US 7,785,237 B2
(45) Date of Patent: Aug. 31, 2010

(54) EXERCISE MACHINE AND GRIPPING COMPONENT THEREOF

(75) Inventors: Nerio Alessandri, Longiano (IT); Mario Fedriga, Forli (IT); Simone Casagrande, Rimini (IT)

(73) Assignee: Technogym S.p.A., Gambettola (FC) (IT)

( * ) Notice: Subject to any disclaimer, the term of this patent is extended or adjusted under 35 U.S.C. 154(b) by 1003 days.

(21) Appl. No.: 10/907,717

(22) Filed: Apr. 13, 2005

(65) Prior Publication Data

US 2006/0199708 A1 Sep. 7, 2006

(30) Foreign Application Priority Data

Mar. 1, 2005 (EP) ..... 05004474

(51) Int. Cl.
*A63B 21/00* (2006.01)

(52) U.S. Cl. ..... 482/83; 482/102

(58) Field of Classification Search ..... 482/83–90, 482/126, 121, 124, 102–106
See application file for complete search history.

(56) References Cited

U.S. PATENT DOCUMENTS 3,462,156 A * 8/1969 Gentry ..... 473/229
4,373,716 A * 2/1983 Pagani ..... 482/130
5,230,689 A * 7/1993 Derby ..... 493/210
5,624,362 A * 4/1997 Wilson ..... 482/139
5,718,654 A * 2/1998 Kennedy ..... 482/139
5,928,117 A * 7/1999 Vittone et al. ..... 482/99
6,022,299 A 2/2000 Stewart
6,988,977 B2 * 1/2006 Webber et al. ..... 482/100
7,074,131 B1 * 7/2006 Renaud ..... 473/219
2004/0072659 A1 * 4/2004 Alessandri et al. ..... 482/99
2004/0082448 A1 4/2004 Martin

FOREIGN PATENT DOCUMENTS

GB 2 085 307 A 4/1982

* cited by examiner

*Primary Examiner*—Jerome Donnelly
(74) *Attorney, Agent, or Firm*—Abelman, Frayne & Schwab

(57) ABSTRACT

An exercise machine having a frame, at least one resistance element supported by a frame and at least one gripping element a user interface and connected to at least one resistance element by means of at least one operating cable; the gripping element having at least one coupling element for at least one end of said cable; the coupling element including a joint freely rotatable with respect to said user interface in such a way that the end of cable becomes stressed solely in traction.

14 Claims, 2 Drawing Sheets

EXERCISE MACHINE AND GRIPPING COMPONENT THEREOF

CROSS-REFERENCE TO RELATED APPLICATIONS

This application claims the benefit of European Community Application No. 05004474.2, filed on Mar. 1, 2005, and incorporated herein by reference, to the extent the subject matter disclosed therein is different from the subject matter disclosed in Italian Patent Application no. RA2004A000008 filed on Feb. 13, 2004.

BACKGROUND OF THE INVENTION

1. Field of the Invention

The present invention relates to an exercise machine which may be used for the execution of training exercises and more particularly to an exercise machine providing a greater versatility of exercises, a greater freedom of exercising movements, an easier gripping, an easier overall use, and a longer durability of components.

2. Description of Related Art

Various exercise machines for the execution of physical exercises are well known in the art and include machines that utilize a weight stack and a pulley system to provide resistance to an exercise movement. A typical exercise machine has a frame, a means to provide resistance mounted on the frame, and a means for interacting with a user, such as a gripping element. Pulleys and cables are most commonly used to connect the means for providing resistance to the means for interacting with a user.

Cables used for that purpose may have a braided core made of textile or metallic material and covered with a sleeve made of braided plastic material. Cables with the textile core are generally more flexible than cables with metal core, but the former often exhibit excessive plastic elongation during use, requiring frequent adjustments of the moving parts of the machine so as to remove the excess cable length caused by wear.

When the means for interacting with a user is a handle, it may have an elongated body and at least one eyelet connected rigidly to the elongated body. The flexible cable is passed through to the inside of the eyelet and locked by means of a knot, but more frequently by a crimped loop, to ensure greater security of the connection. In other cases, the handle is positioned on route of the flexible cable, and is therefore connected to the flexible cable by means of respective end sections which may have eyelets for crimped loops, typically one for each segment of the cable.

In other designs, the handle terminates with end sections, each one of which has housing with a transverse section sufficiently large to accommodate the end of the corresponding segment of the cable knotted onto itself or having a restraining component. The cable is placed in communication with the outside by means of a conduit which, similarly to the ordinary bicycle brake levers, has a transverse section of a size substantially identical to the transverse section of the cable, in order to make the holding function of the end of the handle effective.

By virtue of what is described above, each length of cable housed inside the conduit leading to the housing for the knot or the restraining component is stressed tangentially by the end of the handle. The cable is therefore bending-deformed in addition to being placed in frictional contact with the edge of the handle as illustrated in FIG. 5. The bending deformation may arise due to linear or rotational movements depending on the type of training carried out by the user. The consequence of the frictional contact is frictional wear of the flexible cable and of the sleeve. The consequence of the bending deformation is fatigue of the cable fibers, typically followed by the unexpected breakage of the cable. In addition, the fatigue of the cable fibers may or may not be preceded by work-hardening of the fibers depending on their structure, but is rarely preceded by a warning signal of the breakage itself.

Failure to keep a watch on the current condition of the cable is a frequent cause of unexpected machine stoppage caused by an unexpected breakage of the cable attached to the handle. Such breakage can also be the cause of injury to the user or to anyone else in the proximity to the exercising machine while it is in use. This situation happens frequently in functional resistance exercise machines, because the movement which can be imparted to the implement in such machines can be executed on any trajectory, which trajectory may vary according to the type of training which the user intends to execute. The possibility of unexpected breakage in conventional exercise machines thus requires the condition of the cable to be frequently monitored, in order to arrange for its replacement prior to critical fatigue conditions.

BRIEF DESCRIPTION OF DRAWINGS

The invention will be described by reference to the annexed drawings, which illustrate non-limiting embodiments of the invention, as follows.

SUMMARY OF THE PRESENT INVENTION

Figure 1:
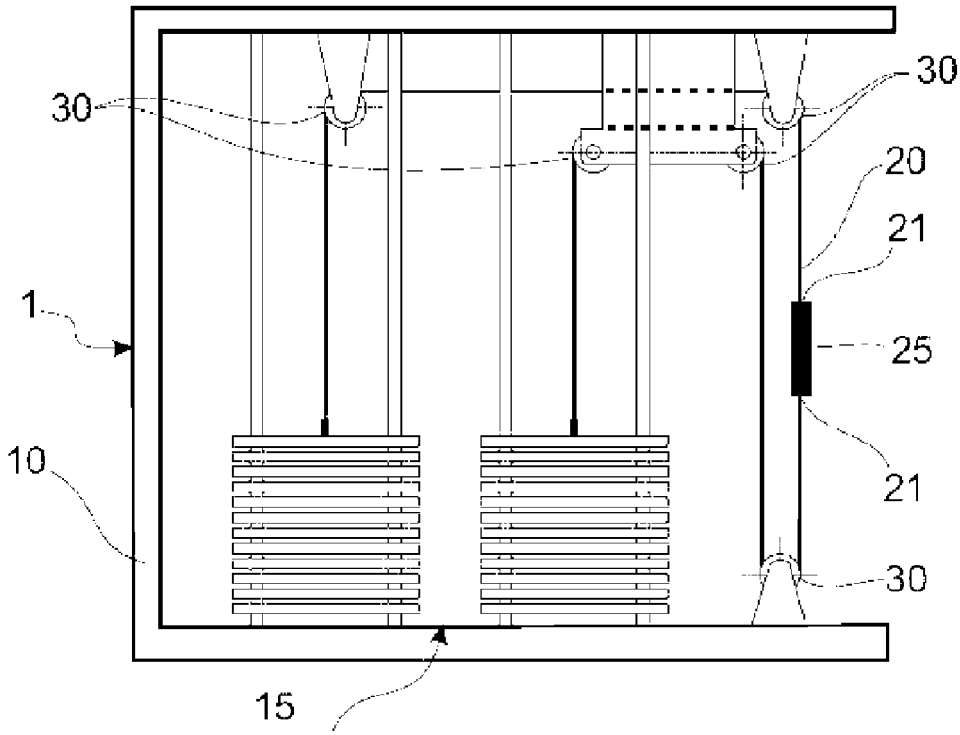
FIG. 1 is a schematic perspective view of an exercise machine 1.

In certain aspects, the present invention relates to an exercise machine for executing physical exercises.

In one embodiment, this invention is directed to an exercise machine for the use by a user for the execution of a physical exercise comprising: a frame; at least one resistance element supported by said frame; at least one cable engaged with said resistance element; and at least one gripping element for transferring forces to and from the user; wherein said gripping element comprises: a user interface for holding the gripping element by the user, and at least one coupling element for attaching of said cable to said gripping element, said coupling element comprising at least one joint for orienting of said coupling element in such a way as to minimize any bending of said cable during multi-dimensional movements of said gripping element relative to said cable.

In one class of this embodiment, the gripping element is a handle.

In a second class of this embodiment, the joint comprises a bracket component carried rotatably with respect to said user interface about a first axis of rotation; the coupling component is carried by said bracket component in a freely rotatable manner with respect to a second axis of rotation; and the first axis of rotation and second axis of rotation are inclined to each other at a first angle. In a subclass of this embodiment, the first angle is substantially 90 degrees.

In a third class of this embodiment, the coupling component further comprises an internal cavity for stably retaining at least one end of said cable, said cavity being disposed eccentrically to said second axis of rotation.

In a fourth class of this embodiment, the coupling element is made up of at least two parts in such a way as to render said cavity easily accessible for the purpose of attaching at least one end of said cable.

In a fifth class of this embodiment, the resistance element is a weight stack.

In a second embodiment, this invention is directed to a handle for an exercise machine comprising: an elongated body having a third axis of rotation; and at least one coupling element for attaching said handle to an exercise machine cable; said coupling element comprising at least one joint, said joint allowing for: (a) rotation of said coupling component around said third axis of rotation and (b) orienting of said coupling element in such a way as to minimize any bending of said cable during multi-dimensional movements of said elongated body relative to said cable.

In one class of this embodiment, the joint comprises a bracket component carried rotatably with respect to said elongated body about said third axis of rotation; the coupling component is carried by said bracket component in a freely rotatable manner with respect to a fourth axis of rotation; and the third axis of rotation and the fourth axis of rotation are inclined to each other at a second angle. In a subclass of this embodiment, the second angle is substantially 90 degrees.

In a second class of this embodiment, the coupling component further comprises an internal cavity for stably retaining at least one end of said cable in such a way as to allow for: (a) rotation of said coupling component around said third and said fourth axes of rotation and (b) orienting of said coupling element in such a way as to minimize any bending of said cable during multi-dimensional movements of said elongated body relative to said cable.

In a third class of this embodiment, the coupling component further comprises a bracket component carried by said elongated body in a coaxially rotatable and axially fixed manner to said third axis; said bracket component supporting said coupling component in freely rotatable manner around a fourth axis of rotation, said fourth axis of rotation being transverse to said third axis of rotation.

In a fourth class of this embodiment, the coupling element is made up of at least two parts in such a way as to render said cavity easily accessible for the purpose of attaching at least one end of said cable.

DETAILED DESCRIPTION OF THE INVENTION

With reference to FIG. 1, 1 indicates, in its entirety, an exercise machine having a frame 10, at least one resistance element 15 supported by frame 10 and at least one cable 20 which connects the resistance element 15 to at least one gripping element 25 employable by a user for the execution of a physical exercise for training or rehabilitation purposes. Frame 10 has one or more pulleys 30 arranged along a route shaped in a fixed way and cable 20 is engaged with the resistance element 15, i.e., it is wound around these pulleys in such a way as to permit the remote operation of the resistance element 15 by the user of the gripping element 25.

A cable and/or pulleys may also be described as "means for connecting a resistance element to a gripping element" and "connecting means" to emphasize that there are various designs and embodiments used to connect a resistance element to a gripping element in exercise machines. Usually, the cable is made of homogeneous braided plastic material, but it may also have an inner braid covered with a sleeve, or even be constructed of metallic material, without this in any way restricting the scope of the present invention.

For convenience, it will be generally referred to exercise machines having a resistance element of gravitational type, i.e., a weight stack, as machines of this type are normally present in every gym and therefore are easily visualized by a person reading this description. However, this choice does not in itself constitute a limitation of the present invention. Other alternative resistance elements, also known as load groups, contemplated within the scope of this invention include, without limitation, springs, elastomeric materials, pneumatic/hydraulic cylinders, and motors. A resistance element may also be described as "means for providing resistance" and "resistance means" to emphasize that there are various designs and embodiments used to provide resistance in exercise machines. A resistance element may include a mechanism for selecting any variety of weight amounts depending on a particular user and exercise. The resistance element may also include the weight of the user himself.

As referred to herein, the terms "gripping element" and "gripping component" encompass an implement that allows for interaction of the user with the exercise machine and for transmission of forces between the exercise machine and the user. A gripping element may also be described as "means for gripping," "means for interacting with a user," and "gripping means" to emphasize that there are various designs and embodiments used to provide gripping by user in exercise machines. The transmission of forces to and from user may occurred when the user is holding the gripping component is his hand, touching it with his foot, or when the gripping component is attached to any other part of his body. The gripping element may be a handle, a pedal, a noose, etc. For example, when the gripping element is a handle, it may be gripped by or pushed by a user during an exercise; when the gripping element is a pedal, it may be pressed or kicked by the user during an exercise; and when the gripping element is a noose, it may be wrapped around the user's wrist, arm, head, legs, ankles, etc. In this context, a "handle" means "a gripping element" being shaped, or having an element shaped, in such a way as to be gripped by a user.

Figure 2:
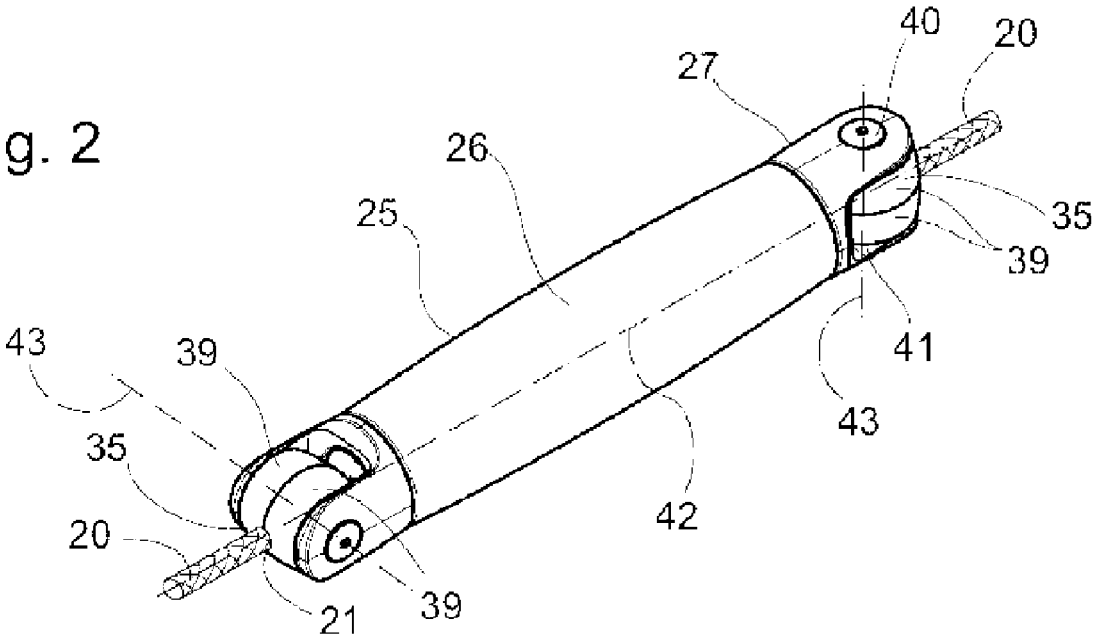
FIG. 2 is a schematic perspective view of a gripping element 26.
Figure 3:
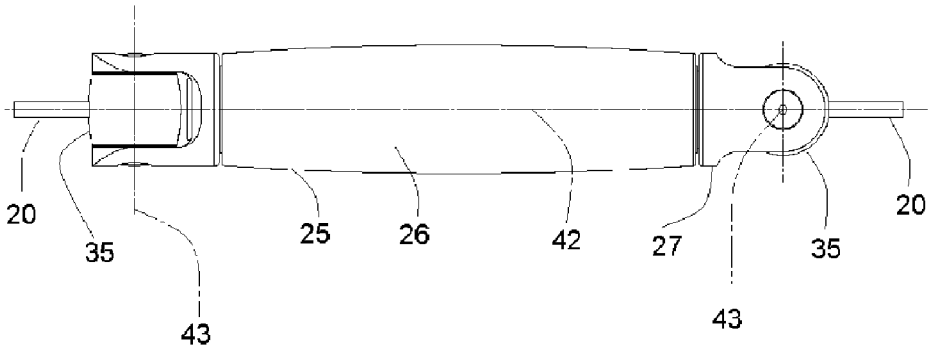
FIG. 3 is a side view of a gripping element 26.

Furthermore, with particular reference to gripping element 25, in one embodiment of the present invention, one, two, or more ends 21 of cable 20 are attached to gripping element 25. In a class of this embodiment, two ends 21 of cable 20 are attached to gripping element 25 as illustrated in FIGS. 1, 2 and 3. This may also be the case, for example, when more than one resistance element is utilized and thus more than one cable is needed, one for each resistance element, or when more than one cable is utilized for one resistance element. In certain embodiments, one cable may have two ends, or it may have more then two ends by the virtue of being shaped in a star-like fashion. Also, when more than one distinct pieces of cable are used, the ends to be attached to the gripping element are sometimes referred herein to as ends of the same cable.

In certain embodiments, gripping element 25 has an application in so-called functional resistance machines, in which the user, in the execution of an exercise, is not obligated to complete movement on a particular trajectory, or a trajectory belonging to a preferred family of trajectories, but is free to interpret the use of machine 1 with greater freedom of movement.

Purely for the sake of clarity, it should be noted that in certain embodiments of the present invention, the exercise machines disclosed herein belong to the type of functional resistance machines, i.e., they allow the user who employs them to freely devise the trajectory of the interface, and possibly to simulate on the exercise machine movements which the user normally makes in the performance of work or a specific sporting activity in order to strengthen the group of muscles which will actually be employed during such performance.

With reference to FIG. 2, gripping element/handle 25 has a user interface 26 and at least one coupling element 27. A user interface 26 is the actual part of the gripping element that normally comes in the contact with the user. The coupling element 27 is comprised of at least one cable interface 35 for coupling with at least one end 21 of cable 20. Furthermore, the coupling element 27 has a joint 40 supporting cable interface 35 in freely rotatable manner with respect to user interface 26, and/or with respect to axes of rotation 42 and 43, in such a way that the end 21 of cable 20 is constantly at rest with relation to cable interface 35. This is to say that the end 21 of cable 20 does not undergo a frictional contact with the coupling component 35, nor does it undergo a bending deformation. Further, the joint 40 allows for orienting of said coupling element in such a way as to minimize any bending of said cable during multi-dimensional movements of said gripping element relative to said cable. In this way the end of cable becomes stressed solely in traction.

Rotary unions, such as swivel joints 40, ball joints, etc., are provided so that the cable 20 is free to orient itself with respect to the user interface. The swivel joints reduce the torque loads transmitted from the gripping element and the user interface to the cable. Swivel joints are designed so as to minimize moments about the axes of rotation of the swivel joints and permit a free rotation of the coupling element with respect to the user interface. Specifically, it is desired that only a linear force but no torsional moment is transmitted to the cable. Such moments are to be avoided because they would cause undesirable deformation (e.g., bending or twisting) of the cable, which would result in shorter lifetimes of the cable, as more fully discussed below. In addition, such moments are to be avoided because they would impart additional stress on the tendons and joints of the user.

A "joint," as used herein, may also be described as "means for joining a gripping element to a cable" and "joining means" to emphasize that there are various designs and embodiments used to connect a gripping element to a cable in exercise machines.

Still with reference to FIG. 2, joint 40 includes a bracket component 41 attached rotatably to user interface 26 around an axis of rotation 42, which bracket component also supports cable interface 35 in a freely rotatable manner around the axis of rotation 43 via the operation of joint 40.

A cable interface may also be described as "means for rotating a cable," "means for freely orienting a cable," and "rotating means" to emphasize that there are various designs and embodiments used to allow for free cable rotation in exercise machines, as described herein.

Axes of rotation 42 and 43 are referred to as first axis, and second axis, respectively, in claims to certain embodiments. For clarity, axes of rotation 42 and 43 are also referred to as second axis, and third axis, respectively, in claims to certain other embodiments. Similarly, for clarity, the angle at which the axes of rotation 42 and 43 intersect each other are referred to as the first angle, in certain claims, and as second angle, in other claims.

In certain embodiments of this invention, the axis of rotation 43 is oriented transversely to axis of rotation 42. In certain embodiments, the axis of rotation 43 is oriented with respect to axis of rotation 42 at an angle of substantially 90 degrees. "Substantially" means in this regard that the angle may be exactly 90 degrees, or that it may be about 90 degrees, e.g., 89.9 degrees or 90.1 degrees, or 89.2 degrees, or 88 degrees, etc. In certain other embodiments, the axis of rotation 43 is oriented with respect to axis of rotation 42 at angles different from the right angle, depending on the particular operating requirements, for example it may be oriented at an angle of 0-90 degrees, and particularly at an angle of 85, or 80, or 75, or 70, or 65, or 60 degrees, at any angle in between, or at various other angles.

With reference to FIG. 3, in certain embodiments of the present invention, an internal cavity 36 is located within the cable interface 35. The cavity 36 is shaped in such a way as to securely hold in place an end 21 of cable 20. The cavity 36 may hold one or more ends of cable 20. In one class of this embodiment, the contours of cavity 36 are shaped like that of a mushroom. In another class of this embodiment, end 21 is knotted on itself. In yet another class of this embodiment, end 21 is provided with a restraining component, for example, a crimping component, attached to the tip of end 21 in such a way as to increase its cross section and to stably engage portion 37 of cavity 36, and to be restrained by neck 38 of cavity 36.

Still with reference to FIG. 3, in another embodiment of the present invention, the cable interface 35 is constructed in two parts 39, in such a way as to make the cavity 36 easily accessible to the end 21 of cable 20. "Easily accessible" as used herein means that such a design allows for an easier attachment of at least one end of cable 20 to the cable interface. For example, the end of cable 20 knotted onto itself may be first placed within a portion of cavity 36 defined by one part 39 and a second part 39 may be added to the first part 39 afterwards, so as to hold the cable 20 securely in place within cavity 36. In one class of this embodiment, the two parts 39 are maintained rigidly connected to each other by means of a rigid dissoluble connection. In one subclass of this embodiment, the rigid dissoluble connection is made by at least one screw 45, and more particularly is by four screws 45 arranged around axis 43, two of which are numbered for convenience as illustrated to the left in FIG. 3. In other embodiment, the cable interface 35 is constructed in more than two parts 39, e.g., in three, four, five, six, or more parts, in such a way as to make the cavity 36 easily accessible to the end 21 of cable 20.

A cavity may also be described as "means for securing (an end of) a cable within the cable interface" and "cable securing means" to emphasize that there are various designs and embodiments used to secure a cable within the cable interface in exercise machines.

Figure 4:
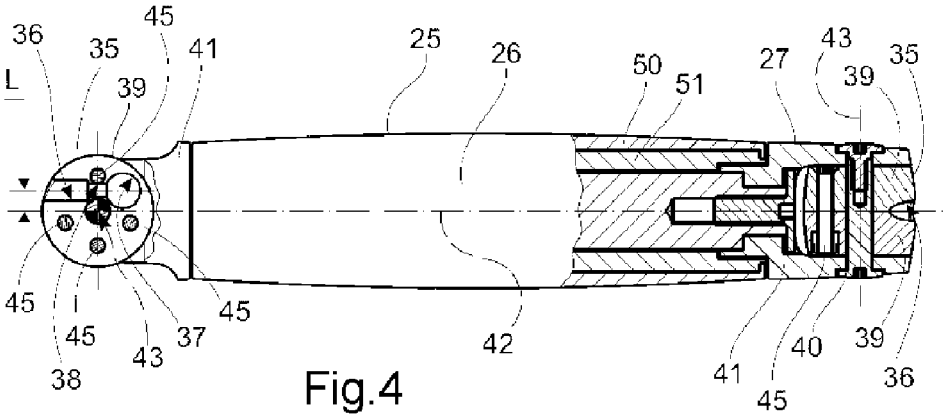
FIG. 4 is a view of a gripping element 26 represented partly as a view and partly in longitudinal section.
Figure 5:
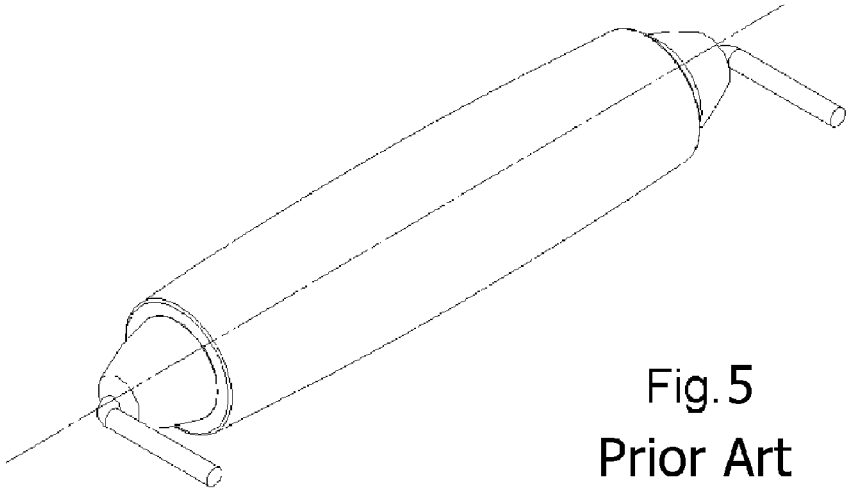
Fig.5 Prior Art
FIG. 5 is a view of a handle as described in prior art showing bending deformation of cable and frictional contact of cable with handle.

In certain embodiments of the present invention, the cavity 36 is located in an eccentric position with respect to axis 42, as is illustrated in the left portion of FIG. 4. The eccentricity L between cavity 36 and axis of rotation 42 is the distance between the axis of rotation 42 and a parallel line that runs through the middle of cavity 36.

The eccentricity L between cavity 36 and axis of rotation 42 can take different values from case to case, so as to permit the operation of joint 40, and in particular the rotation of cable interface 35 with respect to axes 42 and 43, even during gentle pulling actions exercised on gripping element 25 on the part of a user. For example, L may be 0, or L may be several micrometers to several centimeters. Particularly, L may be from 1 mm to 30 mm. It is explicitly noted that in cases in which the eccentricity L is zero (no eccentricity), the rotation of joint 40 may not always be assured for the purposes of effective elimination of rubbing of end 21 of cable 20 against the cable interface 35.

In any case, it is appropriate to emphasize that the maintenance of the relative rest between the end 21 of cable 20 and the cable interface 35 allows for the complete elimination of:

(a) fatigue of cable 20 in the proximity to the respective end 21; (b) the problems associated with said fatigue; and (c) the problems of wear of the associated sleeve, in such a way as to allow a perceptible increase in the life of cable 20. In this way, the temporal intervals between maintenance sessions for cable 20 are prolonged, and the probability of thinning by progressive breakage from fatigue of metallic strands of the core of cable 20 is minimized. This improvement also minimizes the chances of the unexpected breakage of cable 20 and prevents injuries to users and those present in the vicinity of the exercising machine during its operation.

From what is described above it appears evident that the gripping component 25 permits the brilliant and final resolution of the problems of fracture through fatigue of the core of cable 20 and the problems of wear of the cable 20, given that even in the vicinity of the respective end 21, cable 20 is subject to tensile stresses only.

Furthermore, it is contemplated as part of this invention that the gripping component 25 can be used to replace any gripping component (e.g., a handle) supplied with any exercise machine having a resistance element, and specifically having a resistance element that can be actuated by at least one cable.

In the event that personalization or ornamentation of the outer surface of user interface 26 is desired (engravings, color, etc.), it is possible to split interface 26 into two coaxial bodies 50 and 51, respectively outer and inner, as illustrated in the right portion of FIG. 3.

The particular embodiment having thus been described, it will now be evident to those skilled in the art that further modifications and variation thereto may be contemplated. Such modifications and variations are not regarded as a departure from the invention.

All publications and patent applications mentioned in this specification are indicative of the level of skill of those skilled in the art to which this invention pertains. All publications and patent applications mentioned in this specification are herein incorporated by reference to the same extent as if each individual publication or patent application mentioned in this specification was specifically and individually indicated to be incorporated by reference.

What is claimed is:

1. An exercise machine for the use by a user for the execution of a physical exercise comprising:

a frame;

at least one resistance element supported by said frame;

at least one cable engaged with said resistance element; and at least one handle, said handle comprising: an elongated user interface having a longitudinal central axis and having longitudinal extremities, and a pair of independent coupling elements connected directly to said longitudinal extremities by means of respective biaxial joints;

wherein each coupling element is arranged in order to directly couple said handle to said at least one cable; and each coupling element is carried by a respective biaxial joint in a freely rotatable manner around both a first axis of rotation, said first axis of rotation being parallel to said longitudinal central axis, and a respective second axis of rotation, said second axis of rotation being inclined to said first axis of rotation at a given angle, for allowing each coupling element to be oriented independently from another coupling element, whereby minimizing any bending of said at least one cable during multi-dimensional movements of said handle along non-predetermined trajectories relative to any said cable;

wherein each coupling element comprises a respective internal cavity for stably retaining a respective end of said at least one cable; and wherein each cavity is disposed eccentrically with respect to said first axis of rotation in order to minimize any bending of said cable during multi-dimensional movements of said elongated body along the non-predetermined trajectories.

2. The exercise machine of claim 1, wherein each biaxial joint comprises a bracket component carried rotatably around said first axis of rotation with respect to said user interface; and each coupling element is carried by said bracket component in a freely rotatable manner around said second axis of rotation.

3. The exercise machine of claim 2, wherein said given angle is substantially 90 degrees, and said first axis of rotation is a symmetry axis for said elongated user interface.

4. The exercise machine of claim 2, wherein each coupling element includes two complementary matching parts whereby rendering each cavity easily accessible for the purpose of attaching the respective end of said at least one cable.

5. The exercise machine of claim 3, wherein each coupling element includes two complementary matching parts whereby rendering each cavity easily accessible for the purpose of attaching the respective end of said at least one cable.

6. The exercise machine of claim 1, wherein said resistance element is a weight stack.

7. The exercise machine of claim 4, wherein said resistance element is a weight stack.

8. The exercise machine of claim 5, wherein said resistance element is a weight stack.

9. A handle for an exercise machine comprising:

an elongated body having longitudinal extremities and having a longitudinal central axis;

a pair of independent coupling elements connected directly to said longitudinal extremities by means of respective biaxial joints;

wherein each coupling element is arranged in order to directly couple said handle to a cable; and each biaxial joint allows for:

(a) rotation of each coupling element around a first axis of rotation, said first axis of rotation being parallel to said longitudinal central axis; and (b) orienting of each coupling element, independently from another coupling element, around a second axis of rotation, said second axis of rotation being inclined to said first axis of rotation at a given angle, whereby minimizing any bending of said cable during multi-dimensional movements of said elongated body along non-predetermined trajectories;

wherein each coupling element includes two complementary matching parts and includes an internal cavity easily accessible for stably attaching a respective end of said cable; and wherein each internal cavity is disposed eccentrically with respect to said first axis of rotation.

10. The handle of claim 9, wherein each biaxial joint comprises a bracket component carried rotatably around said first axis of rotation with respect to said elongated body; and each coupling element is carried by said bracket component in a freely rotatable manner around said second axis of rotation.

11. The handle of claim 9, where each internal cavity allows for:

(a) rotation of each coupling element around said second axis of rotation under the action of said cable; and (b) orienting of each coupling element around said second axis of rotation in order to minimize any bending of said cable during multi-dimensional movements of said elongated body relative to said cable.

12. The handle of claim 9, wherein said given angle is substantially 90 degrees.

13. The handle of claim 9, wherein said first axis of rotation is a symmetry axis for said elongated body.

14. The handle of claim 11, wherein each biaxial joint comprises a bracket component carried by said elongated body in a coaxially-rotatable and axially-fixed manner with respect to said first axis; and each bracket component supports said respective coupling element in a freely rotatable manner around said second axis of rotation, said second axis of rotation being transverse to said first axis of rotation.

* * * * *